United States Patent [19]

Shiozawa et al.

[11] 4,347,047

[45] Aug. 31, 1982

[54] HYDRAULIC PUMP FOR POWER STEERING

[75] Inventors: Shookichi Shiozawa; Tomomi Nakayama, both of Susono; Kyosuke Haga, Anjo; Ryutaro Abe, Toyokawa; Yoshiyuki Takeuchi, Gamagori, all of Japan

[73] Assignees: Toyoda Koki Kabushiki Kaisha, Kariya; Toyota Jidosha Kogyo Kabushiki Kaisha, Toyota, both of Japan

[21] Appl. No.: 177,911

[22] Filed: Aug. 14, 1980

[30] Foreign Application Priority Data

Aug. 16, 1979 [JP] Japan ..... 54/103529

[51] Int. Cl.[3] ..... F04B 49/02; F04B 49/08

[52] U.S. Cl. ..... 417/310

[58] Field of Search ..... 417/310, 300

[56] References Cited

U.S. PATENT DOCUMENTS 2,910,944 11/1959 Pettibone ..... 417/310 X 3,125,028 3/1964 Rohde ..... 417/310 X 3,207,077 9/1965 Zeigler ..... 417/310 X 3,901,628 8/1975 Bornholt et al. ..... 412/310 X

*Primary Examiner*—Richard E. Gluck

*Attorney, Agent, or Firm*—Oblon, Fisher, Spivak, McClelland & Maier

[57] ABSTRACT

A vane type hydraulic pump for use in a power steering apparatus comprising a pump housing receiving therein a non-rotatable cam ring and first and second non-rotatable but axially slidable side plates. A pump rotor rotatable integrally with a drive shaft is received in an internal cam bore of the cam ring and, when rotated, delivers pressurized fluid to a discharge port connected to the power steering apparatus. The first and second side plates define at a contact portion therebetween a radial low pressure cavity, which is fluidically communicated with an axial low pressure hole receiving working fluid from a pump reservoir and bypassed fluid from a flow volume control valve. A branch member is provided on one of the side plates to smoothly branch the fluid flow flowing in the low pressure hole in the axial direction into the flow flowing along the low pressure cavity in the radial direction.

3 Claims, 7 Drawing Figures

HYDRAULIC PUMP FOR POWER STEERING

BACKGROUND OF THE INVENTION

1. Field of the Invention

The present invention relates to a hydraulic pump used together with an automotive power steering apparatus.

2. Description of the Prior Art

In hydraulic pumps used together with automotive power steering apparatus, since a pump rotor is rotated by an automotive engine, a flow rate of pressurized fluid discharged from a pump is increased in proportion to an increase in a rotational speed of the engine. For this reason, it has been a practice to reduce engine power loss by providing the pump with a flow volume control valve for bypassing to a low pressure zone a surplus flow volume other than a constant flow volume that a power steering apparatus consumes.

However, in these conventional pumps, when the pump rotor is rotated at a high speed as rotation of the engine is increased, a greater amount of bypass fluid is returned to the inlet port of the pump and thus cavitation has been caused in the bypass fluid, which has been the cause of reduction of pump efficiency and unpleasant noise.

SUMMARY OF THE INVENTION

It is, therefore, an object of the present invention to provide an improved hydraulic pump which has high pump efficiency and less energy loss by preventing cavitation in a bypass flow.

Another object of the present invention is to provide an improved hydraulic pump of the character set forth above, wherein a branch member is provided to smoothly branch an axial low pressure flow in a low pressure hole into a radial flow to be conducted into inlet ports of the pump.

Briefly, according to the present invention, these and other objects are achieved by providing a hydraulic pump for use in a power steering apparatus, as mentioned below. A pump housing has an intake hole and a discharge port. A cam ring is received in the pump housing and has an internal cam bore. A drive shaft is rotatably carried by the pump housing and extends into the internal cam bore in coaxial alignment with the axis of the internal cam bore. A pump rotor is carried on the drive shaft for integral rotation therewith and received in the internal cam bore for defining a pump chamber. A pressure plate is received in the pump housing in contact relationship with the cam ring for defining inlet port means fluidically communicated with an inlet area of the pump chamber and outlet port means fluidically communicated with an outlet area of the pump chamber. A subplate is received in the pump housing in contact relationship with the pressure plate for defining at a contact portion with the pressure plate a low pressure passage extending in a diametral direction and communicated with the inlet port means. The pump housing is formed with a low pressure hole in coaxial relationship with the internal cam bore and communicated at one end thereof with the bypass passage and at the other end thereof with the intake hole. The subplate defines between itself and the pump housing a pressure chamber fluidically communicated with the outlet port means of the pressure plate through the subplate. A throttle element is disposed on the discharge port through which pressurized fluid from the pressure chamber is discharged. A flow volume conrol valve is responsive to the pressure difference across the throttle element for returning a part of pressurized fluid through the low pressure hole and the low pressure passage. A branch member is provided for branching the flow of fluid flowing in the low pressure hole in the axial direction into the flow flowing along the low pressure passage in the radial direction.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
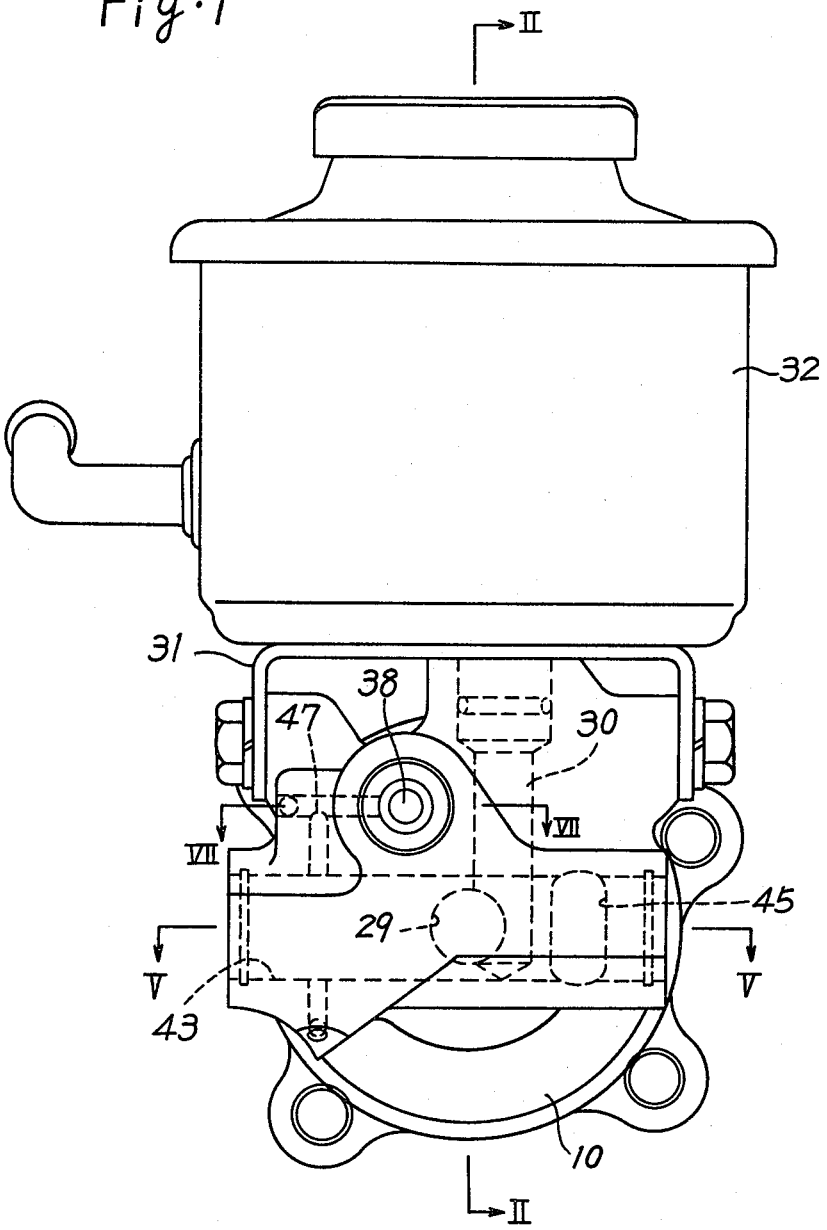
FIG. 1 is a side elevational view of a hydraulic pump for use in a power steering apparatus.
Figure 2:
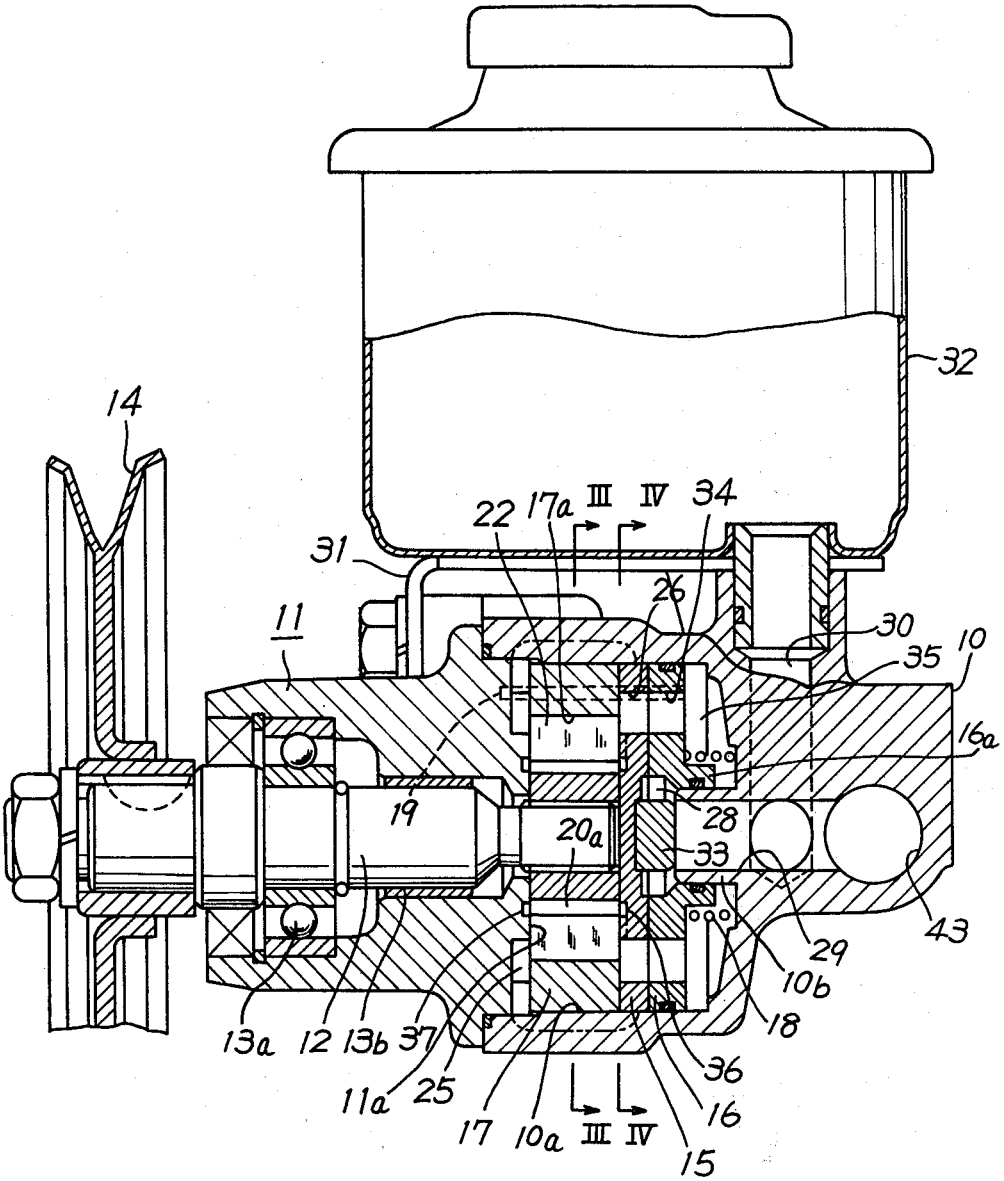
FIG. 2 is a sectional view taken along the lines II—II in FIG. 1.

Referring now to the drawings, wherein like reference numerals refer to identical or corresponding parts throughout the several views, and more particularly to FIGS. 1 and 2, there is shown a pump body 10, on which a support member 11 is fixedly inserted into one open end of the inner bore 10*a* of the pump body 10 so as to constitute a pump housing. A drive shaft 12 is rotatably carried by the support member 11 through bearings 13*a* and 13*b* and supports at its one end outside the support member 11 a pulley 14 which is connected through belts to an automotive engine, not shown, to be driven thereby.

A pressure plate 15 and a subplate 16 are slidably received in the inner bore 10*a* of the pump body 10 in juxtaposed contact relationship with each other. The subplate 16 is snugly fitted at its inner bore on a cylindrical sleeve portion 10*b* extended from the bottom wall of the inner bore 10*a* in coaxial relationship with the inner bore 10*a*. A cam ring 17 is interposed between the pressure plate 15 and one side wall 11*a* of the support member 11 and is held in position by means of a plurality of pins 19, which extend through the subplate 16, the pressure plate 15, the cam ring 17 and the support member 11. A spring 18 is interposed between the bottom wall of the inner bore 10*a* and the subplate 16 to urge the subplate 16, the pressure plate 15 and the cam ring 17 toward the side wall 11*a* of the support member 11.

Figure 3:
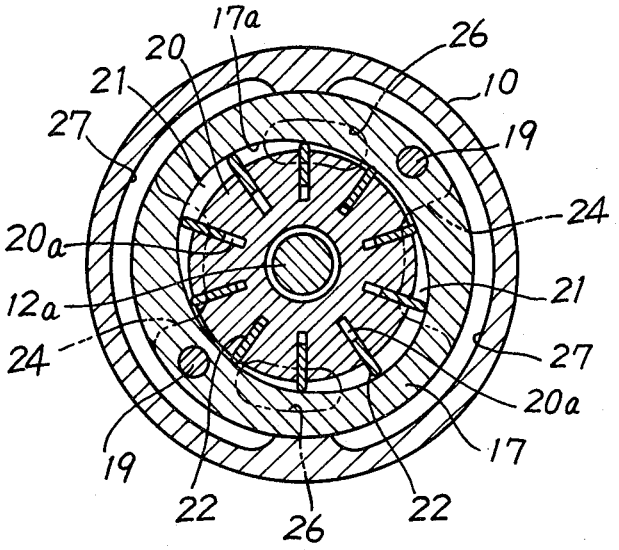
FIG. 3 is a sectional view taken along the lines III—III in FIG. 2.

The cam ring 17 is formed with an internal cam surface 17*a*, as illustrated in FIG. 3, and within a space defined by the cam surface 17*a*, the support member side wall 11*a* and the pressure plate 15 there is rotatably contained a pump rotor 20, which is carried on the drive shaft 12 through a spline connection therewith. Accordingly, the pump rotor 20, together with the cam surface 17*a* of the cam ring 17, define two cresent-shaped pump chambers 21 with an angular separation of 180 degrees. The pump rotor 20 is formed on its circumferential surface with a plurality of radial slots 20*a*, within which are slidably received respective vanes 22 contacting the cam surface 17*a* of the cam ring 17. These vanes 22 separate each pump chamber 21 into a plurality of sealed chambers.

Figure 4:
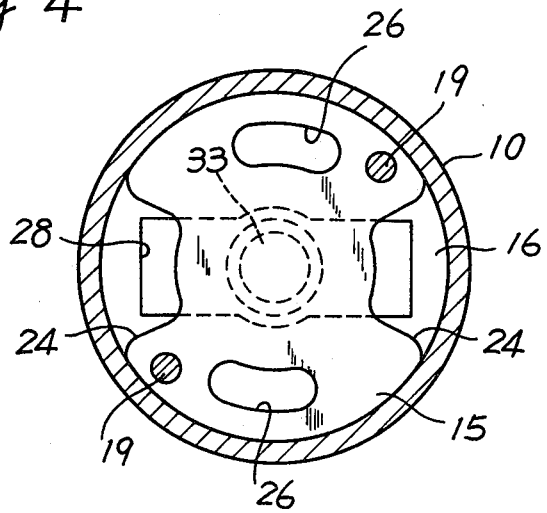
FIG. 4 is a sectional view taken along the lines IV—IV in FIG. 2.
Figure 5:
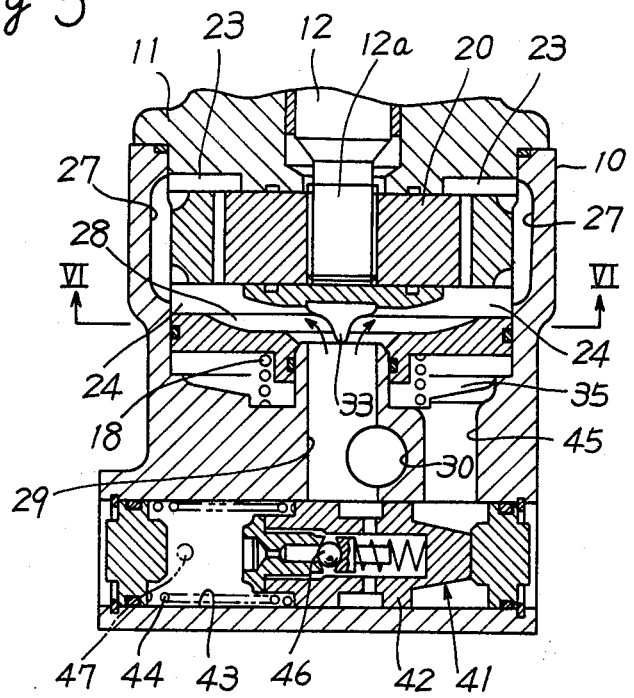
FIG. 5 is a sectional view taken along the lines V—V in FIG. 1.
Figure 6:
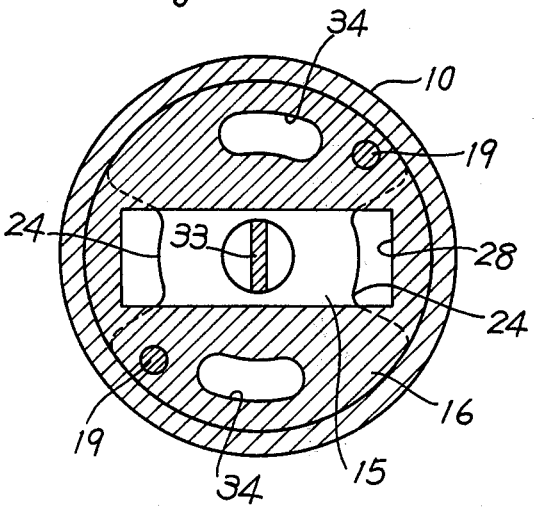
FIG. 6 is a sectional view taken along the lines VI—VI in FIG. 5.

As shown in FIGS. 2 to 5, the support member side wall 11*a* and the pressure plate 15 are respectively formed with inlet ports 23 and 24 opening to inlet areas of the pump chambers 21 and further with outlet ports 25 and 26 opening to outlet areas of the pump chambers 21. The inlet ports 23, 24 and the outlet ports 25, 26 are alternately disposed with an angular distance of approximate 90 degrees, as shown in FIG. 3. The inlet ports 23 and 24 are in fluid communication with each other through arc-shaped grooves 27 formed in the pump body 10. The inlet ports 24 formed in the pressure plate 15 with angular separation of 180 degrees are fluidically communicated with a low pressure hole 29 formed in the pump body 10 through a low pressure cavity 28, which is formed so as to extend in a diametral direction at an abutting or contact portion between the pressure plate 15 and the subplate 16, as shown in FIGS. 4 to 6. The low pressure hole 29 is formed in the pump body 10 in coaxial relationship with the inner bore 10*a* and is in fluid communication through a vertical intake hole 30 with a reservoir 32, which is mounted on the pump body 10 by the use of a bracket 31. At the center of the pressure plate 15, there is provided a branch member 33 facing the low pressure hole 29, which is formed in such a smooth curved surface as to branch the flow of fluid flowing in the low pressure hole 29 in the axial direction into the flow flowing along the low pressure cavity 28 in the radial direction.

The outlet ports 26 formed on the pressure plate 15 are in fluid communication through outlet recesses 34 extending through the subplate 16 with a pressure chamber 35 defined between the subplate 16 and the pump body 10. The outlet ports 26 are also communicated with a balancing annular groove 36 formed on a side surface of the pressure plate 15, and the balancing groove 36 is, in turn, communicated with all of the radial slots 20*a*. The side wall 11*a* of the support member 11 is formed with a balancing annular groove 37 in face to face relationship with the balancing groove 36, and the balancing groove 37 is, in turn, communicated with all of the radial slots 20*a*.

Figure 7:
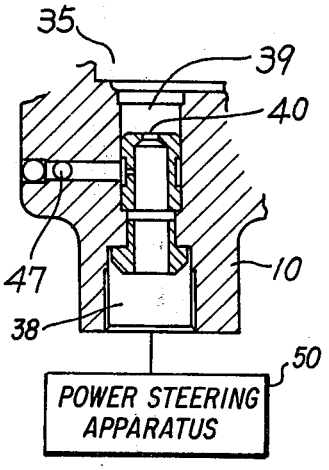
FIG. 7 is a sectional view taken along the lines VII—VII in FIG. 1.

Referring to FIGS. 1 and 7, a discharge port 38 is formed in the pump body 10 and is in communication with the pressure chamber 35 through a passage 39 into which a throttle element or orifice 40 is provided for causing pressure difference thereacross.

Referring to FIG. 5, there is shown a flow volume control valve 41 for controlling a flow volume of pressurized fluid delivered from the discharge port 38 to a power steering apparatus, not shown. The control valve 41 comprises a valve spool 42 which is slidably received in a valve bore 43 formed in the pump body 10 to intersect with the low pressure hole 29. One end of the valve bore 43 is in communication with the pressure chamber 35 through a passage 45 formed in the pump body 10. The other end of the valve bore 43 is in communication with the downstream of the orifice 40 through a passage 47 formed in the pump body 10, as shown in FIGS. 1 and 7. A spring 44 is interposed in the other end of the valve bore 43 to urge the valve spool 42 toward the one end of the valve bore 43 to thereby close fluid communication between the low pressure hole 29 and the pressure chamber 35 through the passage 45. Accordingly, the flow volume of pressure fluid delivered from the discharge port 38 through the orifice 40 to the power steering apparatus is controlled to be always constant by the valve spool 42 which controls the extent of communication between the low pressure hole 29 and the pressure chamber 35 through the passage 45 and the other end of the valve bore 43 so as to maintain the pressure difference across the orifice 40 constant. Numeral 46 denotes a pressure relief valve provided in the valve spool 42.

In operation, when the pump rotor 20 is drivingly rotated together with the drive shaft 12 by an automotive engine, working fluid is sucked from the reservoir 32 into the inlet areas of the pump chambers 21 through intake hole 30, low pressure hole 29, bypass cavity 28, arc-shaped grooves 27 and inlet ports 23, 24. At this time, the branch member 33 branches the flow of fluid flowing in the low pressure hole 29 in the axial direction into the flow flowing along the bypass cavity in the radial direction towards the inlet ports 24. The working fluid pressurized at the outlet areas of the pump chambers 21 is delivered to the power steering apparatus 50 through outlet ports 26, outlet recesses 34, pressure chamber 35, passage 39, orifice 40 and discharge port 38. A part of the working fluid delivered to the outlet ports 26 is conducted to the radial slots 20*a* and the balancing groove 37 through the balancing groove 36, so that the vanes 22 are pressed upon the cam surface 17*a* of the cam ring 17 with the pump rotor 20 balancing in the axial direction. Furthermore, the pressurized working fluid within the pressure chamber 35 causes the pressure plate 15 to be pressed against the cam ring 17 through the subplate 16.

The flow rate of the working fluid delivered from the pressure chamber 35 is proportional to the rotational speed of the pump rotor 20, namely to the engine rotational speed. When the flow rate is increased with an increase of the engine rotational speed, the pressure at the upperstream of the orifice 40 is raised with the result that the spool valve 42 is moved to the left, as viewed in FIG. 5, against the force of the spring 44 so as to open the communication between the one end of the valve bore 43 and the low pressure hole 29. Therefore, a part of the working fluid flowing into the one end of the valve bore 43 is thus bypassed into the low pressure hole 29, and the bypassed flow joins the flow from the intake hole 30 to be smoothly conducted to the inlet ports 24 through the low pressure cavity 28 with the aid of the branch member 33. Such control of the bypass flow by the valve spool 41 permits the pressure difference across the orifice 40 to be maintained constant, whereby the working fluid is delivered from the discharge port 38 to the power steering apparatus always at a constant flow rate.

Obviously, numerous modifications and variations of the present invention are possible in light of the above teachings. It is to be understood, therefore, that within the scope of the appended claims, the invention may practiced otherwise than as specifically described herein.

What is claimed as new and desired to be secured by Letters Patent of the United States is:

1. A hydraulic pump for use in a power steering apparatus comprising:

a pump housing having an intake hole and a discharge port;

a cam ring received in said pump housing and having an internal cam bore;

a drive shaft rotatably carried by said pump housing and extending into said internal cam bore in coaxial alignment with the axis of the center of symmetry of said internal cam bore;

a pump rotor carried on said drive shaft for integral rotation therewith and received in said internal cam bore for defining a pump chamber;

a pressure plate received in said pump housing in contact relationship with said cam ring for defining inlet port means fluidically communicated with an inlet area of said pump chamber and outlet port means fluidically communicated with an outlet area of said pump chamber;

a subplate received in said pump housing in contact relationship with said pressure plate for defining at a contact portion with said pressure plate a low pressure passage extending in a diametral direction and communicated with said inlet port means;

said pump housing being formed with a low pressure hole in coaxial relationship with said internal cam bore and communicated at one end thereof with said low pressure passage and at the other end thereof with said intake hole;

a pressure chamber between said subplate and said pump housing wherein said pressure chamber is fluidically communicated with said outlet port means of said pressure plate through said subplate;

a throttle element disposed on said discharge port through which pressurized fluid from said pressure chamber is discharged;

a flow volume control valve responsive to the pressure difference across said throttle element for returning a part of pressurized fluid through said low pressure hole and said low pressure passage; and a branch member for branching the flow of fluid flowing in said low pressure hole in the axial direction into the the flow flowing along said low pressure passage in the radial direction.

2. A hydraulic pump as set forth in claim 1, wherein said branch member is formed at the center of said pressure plate.

3. A hydraulic pump as set forth in claim 1 or 2, wherein said branch member has a smooth curved surface.

* * * * *